US006082160A

United States Patent [19]

Martyniak

[11] Patent Number: 6,082,160

[45] Date of Patent: Jul. 4, 2000

[54] ANTI-KEY INSERTION DEVICE

[76] Inventor: Russell W. Martyniak, 300 Oakdale St., Toms River, N.J. 08757

[21] Appl. No.: 09/290,320

[22] Filed: Apr. 12, 1999

[51] Int. Cl.[7] ..... E05B 17/00; A47G 29/10

[52] U.S. Cl. ..... 70/431; 70/430; 70/441; 70/458; D3/208

[58] Field of Search ..... 70/430, 457, 458, 70/431, 1, 441; D3/209–214

[56] References Cited

U.S. PATENT DOCUMENTS

| | | | |
|---|---|---|---|
| 1,636,392 | 7/1927 | Stubbs | 70/430 |
| 3,119,429 | 1/1964 | Stiller et al. | 70/457 |
| 3,124,286 | 3/1964 | Dompier . | |
| 3,874,204 | 4/1975 | Capri | 70/427 |
| 3,974,543 | 8/1976 | Thomas | 24/67.11 |
| 4,121,360 | 10/1978 | Vlerebome . | |
| 4,653,422 | 3/1987 | Allen . | |
| 5,419,408 | 5/1995 | Ellrodt et al. | 70/226 |
| 5,501,090 | 3/1996 | Mattiuzzo | 70/458 |
| 5,689,981 | 11/1997 | DeLuca et al. | 70/441 |
| 5,813,262 | 9/1998 | Crumley et al. | 70/457 |
| 5,842,365 | 12/1998 | Bordonaro | 70/457 |
| 5,884,513 | 3/1999 | Norris | 70/456 R |
| 5,884,514 | 3/1999 | Willis | 70/457 |

FOREIGN PATENT DOCUMENTS

| | | | |
|---|---|---|---|
| 254758 | 5/1912 | Germany | 70/458 |

*Primary Examiner*—Darnell Boucher
*Attorney, Agent, or Firm*—Clifford G. Frayne

[57] ABSTRACT

A reminder device attachable to a key ring and engageable with a key shaft to prevent the utilization of the key and thus remind the user of a task to be performed. The device is designed from a single piece of clear flexible plastic, which can be repeatedly stretched. At one end of the clear flexible plastic is a tube (10). The tube (10) has a inner opening (12) and a outer opening (14). At the other end of the clear flexible plastic is a ring terminal (16), which has a hole (18) at the center. At the middle of the clear flexible plastic is a thin bridge (20), which connects tube (10) to the ring terminal (16). The ring terminal (16) attaches to the key ring and the tube (10) is selectively engageable with a key shaft of a key on the key ring.

2 Claims, 1 Drawing Sheet

ANTI-KEY INSERTION DEVICE

CROSS-REFERENCE TO RELATED APPLICATIONS

Not applicable.

BACKGROUND-FIELD OF INVENTION

This invention relates to insertion blockers, specifically concerning keys and their respective key holes.

BACKGROUND-DESCRIPTION OF PRIOR ART

How do you stop a car thief from starting your car? One idea is to prevent the ignition key from entering the ignition key hole. U.S. Patent 3,874,204 to Capri (1975) has a dummy key that is slipped into the ignition, then locked into the ignition with a padlock.

This idea is good to prevent someone else from starting your car, but what if you do not want to start up your own car on purpose. The present invention is not an anti-theft device, it is a reminder device. The present invention has a plastic tube which is slipped over your car key. Now it is physically impossible to start your car because the tube stops the key from going into the ignition, therefore reminding you to do something.

Assume your spouse phones you to bring something home from work. You immediately slip this tube over your car key and go back to work. Hours later it is time to go home and you have forgotten about bringing something home from work. With the present invention on your key you cannot physically start your car, therefore reminding you to bring something home.

The present invention is not limited to car keys like the previous art, U.S. Patent 3,874,204 to Capri. The present invention can be used on house keys, padlock keys, locker keys and any other key associated device. It is simple, cost effective, light to carry and fits on your key ring.

SUMMARY OF THE INVENTION

The invention is a reminder device which attaches to keys. When you position the present invention on your car key, the device will not let you start your car and thereby reminds you what ycu were supposed to do before you leave. The present invention comprises a flexible plastic member having a tubular first end, a ring terminal end for affixation to a key ring, and a flexible plastic bridge member connecting the tubular member with the ring terminal member allowing the tubular first end to engage the operative end of the key, namely, the key shaft.

OBJECTS OF THE INVENTION

Accordingly, several objects and advantages of the present novel invention are an novel invention are an anti-key insertion device which fits on a personal key ring; is light weight and small enough to carry around on the key ring; is easy, convenient and fast to operate and serves as a reminder device to perform a task before starting your car. A still further object and advantage of the present novel invention is to save gas, mileage and wear on automobile by not having to perform a second trip; to save time and business because you forgot important files information, or other objects which you should have taken with you before you left; and to save stress by not getting mad at oneself or others because your forgot to do something.

BRIEF DESCRIPTION OF THE DRAWINGS

These and other objects of the present invention will become apparent particularly when taken in light of the following illustrations wherein.

DETAILED DESCRIPTION OF THE DRAWINGS

Figure 1:
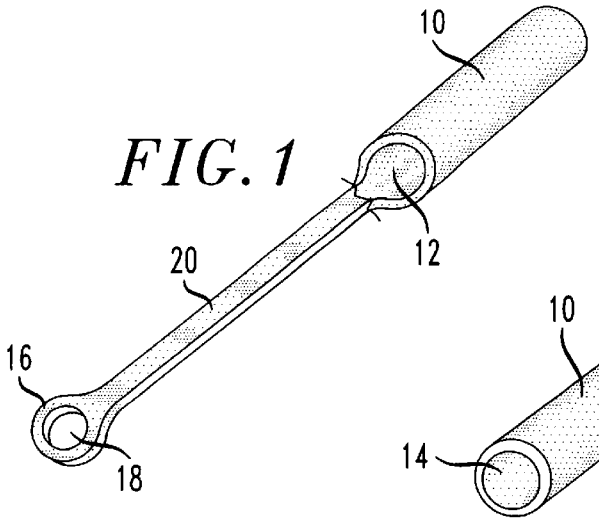
FIG. 1 is a perspective view of the anti-key insertion device.
Figure 2:
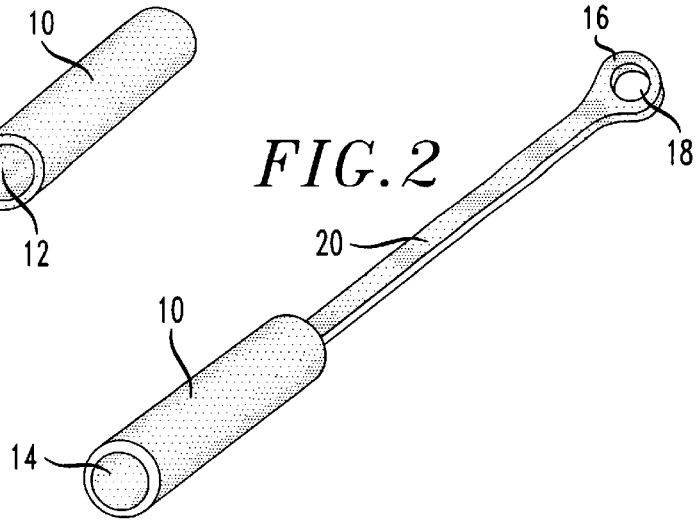
FIG. 2 is a reverse perspective view of the anti-key insertion device.

The anti-insertion device is illustrated in FIGS. 1 (perspective view) and 2 (perspective view) which are opposing perspective views of the anti-insertion device. Preferably, the anti-insertion device is designed from a single piece of clear, flexible plastic which can be repeatedly stretched. One end of the clear, flexible plastic is formed with a tubular member 10 which has a diameter of about one-quarter of an inch and a length of about one-inch. Tubular member 10 has a first open end 12 and a second open end 14 which allows for the positioning in tubular member 10 of the operative portion of a key. At the opposing end of the anti-key insertion device is a clear, flexible plastic ring terminal 16 which is approximately three eighths of an inch in width and has an aperture 18 at its center. Ring terminal 16 and tubular member 10 are secured by a clear, flexible plastic bridge 20 which is about 2 inches long and about an eighth of an inch in width. The anti-key insertion device has three distinct elements, but can be molded or formed in one piece construction from any suitable flexible plastic.

Figure 3:
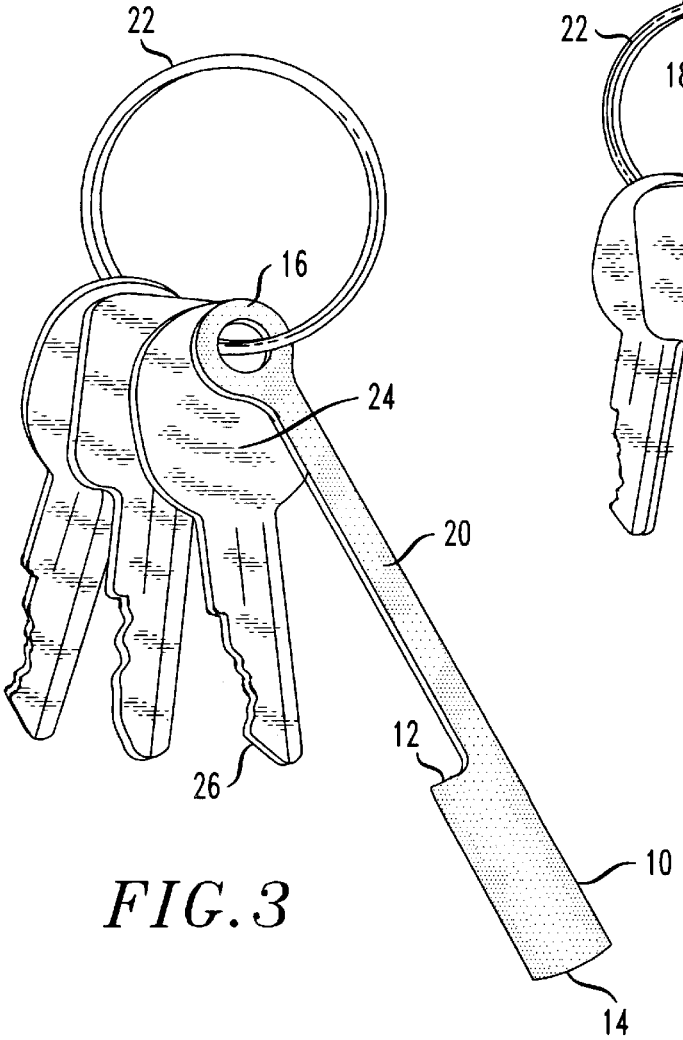
FIG. 3 is a perspective view of the anti-key insertion device positioned on a key ring.
Figure 4:
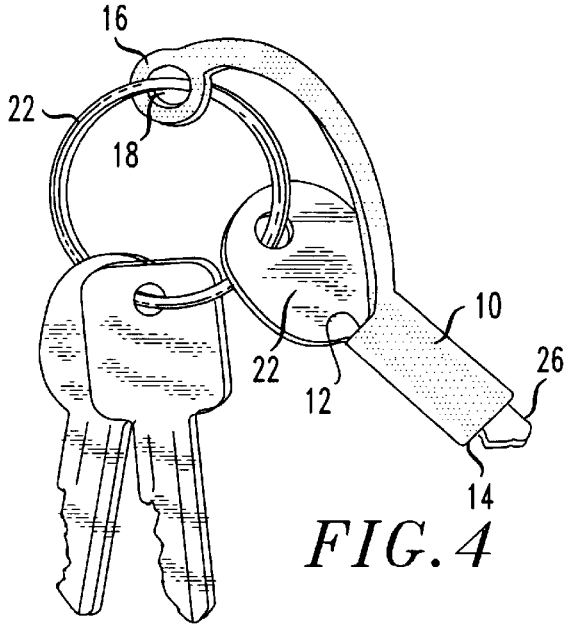
FIG. 4 is a perspective view of the anti-key insertion device positioned on a key ring and cooperative with a key to prevent its insertion into a lock or ignition.

In operation, the anti-key insertion device an individual's personal key ring 22 as illustrated in FIG. 3. It would be positioned on key ring 22 in the same fashion as the keys on key ring 22 would be positioned thereon depending upon the type of mechanism incorporated into the key ring. In that regard, the aperture 18 in ring terminal 16 would be slidably positionable on the key ring 22. Due to its light weight and size, the anit-key insertion device does not significantly add to the weight of the key ring, nor does it interfere with the use of the keys on the key ring 22 when it is not in use for its intended purpose.

For example purposes for the operation of the anti-key insetion device, we will presume that a car key 24 is being utilized. If the individual wishes to remind himself of a task which he must perform before he leaves his present location or before he arrives at his next destination, the individual would position the car key 24 head in one hand and the tubular member 10 in the opposing hand. The bridge 20 being stretchable allows the individual to now pull the tubular member 10 over the top of the car key 24 and engage key shaft 26 and to insert the key shaft 26 into the first open end 12 of tubular member 10 and slide it out the second open end 14 until tubular member 10 is positioned on the key shaft 26. Tubular member 10 is dimensioned such that its passageway allows it to be maintained on key shaft 26 by frictional engagement. The device is now in place and one cannot physically insert the car key 24 into the ignition because of the positioning of tubular member 10 on key shaft 26. The individual is thus reminded that a task must be performed before starting the car or before arriving at the individual's next location.

In conclusion, the anti-key insertion device is a reminder device. By positioning my invention on the automobile key, one cannot start their automobile. This will remind them of duties to be done before they leave for their next destination or before they arrive at their next destination. The invention can be used on other keys other than car keys but has particular application to car keys. The invention is one piece, light weight, small, and fits on one's personal key ring.

The preceding description contains the preferred embodiment of the invention but variations are possible. It may be made of a different material such as rubber and it may have different dimensions and it may also be pigmented. Further, the preferred invention is of one piece construction as illustrated, however, the ring terminal may be made of metal which is crimped to the material comprising the bridge member.

While the present invention has been described with respect to the exemplary embodiments thereof, it will be recognized by those of ordinary skill in the art that many modifications and changes can be made without departing from the spirit and scope of the invention and therefore it is manifestly intended that the invention be limited only by the scope of the claims and the equivalence thereof.

I claim:

1. A anti-key insertion device, comprising:

(a) a tube which has a least one end opened for inserting key shafts, and (b) a terminal to accommodate key rings is opposite said tube, and (c) said tube is connected to said terminal by means of a bridge whereby keys cannot enter respective keyholes while device is implemented.

2. A anti-key insertion device, comprising:

(a) a tube which has at least one end opened for inserting key shafts, and (b) a terminal to accommodate key rings is opposite said tube, and (c) a bridge connecting said tube to said terminal whereby keys cannot enter respective keyholes while device is implemented.

* * * * *

UNITED STATES PATENT AND TRADEMARK OFFICE

CERTIFICATE OF CORRECTION

PATENT NO. : 6,082,160
DATED : July 4, 2000
INVENTOR(S) : Russell W. Martyniak

It is certified that error appears in the above-identified patent and that said Letters Patent is hereby corrected as shown below:

Delete Claims 1 and 2 as they appear in column 4, lines 2-17 and substitute the following therefore.

-- 1. An anti-key insertion device, comprising:

a flexible, resilient, one piece polymer member having a tubular portion defining a passageway therethrough, said tubular portion, slidably frictionally engageable over a key shaft of a key positioned on a key ring;

a ring terminal portion having an aperture therethrough for engagement with said key ring;

a bridge portion in communication with said ring terminal portion and said tubular portion securing said tubular portion to said key ring.

2. An anti-key insertion device in combination with a key ring and a key on said key ring to prevent the insertion of the key shaft into a key receptacle, the anti-key insertion device comprising:

a one piece polymer member having a ring terminal portion having an aperture therethrough for engagement with said key ring;

a tublar portion defining a passageway therethrough;

a bridge portion extending between said ring portion and said tubular portion securing said tubular portion to said key ring, said bridge portion extendable so as to permit said tubular portion to be slidably frictionally engaged over said key shaft. --

Signed and Sealed this

Twenty-fifth Day of December, 2001

*Attest:*

*Attesting Officer*

JAMES E. ROGAN
*Director of the United States Patent and Trademark Office*